US011444386B2

(12) United States Patent
Tripon-Canseliet et al.

(10) Patent No.: US 11,444,386 B2
(45) Date of Patent: Sep. 13, 2022

(54) RECONFIGURABLE ANTENNA ASSEMBLY HAVING A METASURFACE OF METASURFACES

(71) Applicants: Paris Sciences et Lettres, Paris (FR); Centre National de la Recherche Scientifique (CNRS), Paris (FR); UNIVERSITA DEGLI STUDI DI SIENA, Siena (IT); Politecnico Di Torino, Turin (IT); Ecole Supérieure De Physique Et De Chimie Industrielles De La Ville De Paris, Paris (FR); Sorbonne Universite, Paris (FR)

(72) Inventors: Charlotte Tripon-Canseliet, Issy les Moulineaux (FR); Stefano Maci, Florence (IT); Cristian Della Giovampaola, Florence (IT); Giuseppe Vecchi, Leini (IT)

( * ) Notice: Subject to any disclaimer, the term of this patent is extended or adjusted under 35 U.S.C. 154(b) by 12 days.

(21) Appl. No.: 17/055,315

(22) PCT Filed: May 14, 2019

(86) PCT No.: PCT/EP2019/062383

§ 371 (c)(1),
(2) Date: Nov. 13, 2020

(87) PCT Pub. No.: WO2019/219708

PCT Pub. Date: Nov. 21, 2019

(65) Prior Publication Data

US 2021/0203077 A1 Jul. 1, 2021

(30) Foreign Application Priority Data

May 14, 2018 (EP) ..... 18305585

(51) Int. Cl.
*H01Q 15/00* (2006.01)

(52) U.S. Cl.
CPC ..... *H01Q 15/0086* (2013.01)

(58) Field of Classification Search
CPC ..... H01Q 15/0086
See application file for complete search history.

(56) References Cited

U.S. PATENT DOCUMENTS 6,417,807 B1 7/2002 Hsu et al.
7,965,249 B1 6/2011 Wolf et al.
(Continued)

FOREIGN PATENT DOCUMENTS

CN 205071428 U * 3/2016
CN 105848406 B * 10/2019 ..... H05K 1/0236
(Continued)

OTHER PUBLICATIONS

Extended European Search Report including Written Opinion for EP18305585.4 dated Nov. 27, 2018; 8 pages.
(Continued)

*Primary Examiner* — Graham P Smith
*Assistant Examiner* — Jae K Kim
(74) *Attorney, Agent, or Firm* — Lerner, David, Littenberg, Krumholz & Mentlik, LLP

(57) ABSTRACT

An antenna assembly, comprising:
- a single substrate having a lower surface and an upper surface;
- an isotropic source of spherical electromagnetic waves configured for emitting surface waves on the upper surface;
- a ground plane formed on the lower surface comprising a metallic deposit on the entire lower surface;
- an antenna element formed on the upper surface comprising a periodic patterns metasurface formed on the substrate by a texture of subwavelength patches, the antenna element comprising:
- a first-scale metasurface defined by a two-dimensional alternation of metal or metamaterial patches having closely spaced vertices in each contiguous element to form small gaps;

(Continued)

a plurality of switches disposed in the gap between the vertexes of the patches, each switch permitting to connect several patches through the vertexes for defining a second-scale metasurface having a pattern thus forming the antenna element; wherein each patch has dimensions which do not depend on the frequency of the waves to be radiated, the antenna element configured for transform the emitting surface waves on leaky waves.

5 Claims, 8 Drawing Sheets

(56) References Cited

U.S. PATENT DOCUMENTS

| | | | | |
|---|---|---|---|---|
| 9,899,744 | B1 * | 2/2018 | Contopanagos | H01Q 15/0086 |
| 2004/0201526 | A1 | 10/2004 | Knowles et al. | |
| 2004/0227667 | A1 | 11/2004 | Sievenpiper | |
| 2017/0126046 | A1 * | 5/2017 | Contopanagos | H02J 7/025 |
| 2020/0076072 | A1 * | 3/2020 | Keyrouz | H05K 1/0236 |

FOREIGN PATENT DOCUMENTS

| | | | | |
|---|---|---|---|---|
| JP | 2016213927 | A * | 12/2016 | |
| WO | 2015163972 | A2 | 10/2015 | |
| WO | WO-2015163972 | A2 * | 10/2015 | H01Q 1/06 |

OTHER PUBLICATIONS

International Search Report including Written Opinion for PCT/EP2019/062383 dated Aug. 2, 2019; 13 pages.

* cited by examiner

RECONFIGURABLE ANTENNA ASSEMBLY HAVING A METASURFACE OF METASURFACES

CROSS-REFERENCE TO RELATED APPLICATIONS

The present application is a national phase entry under 35 U.S.C. § 371 of International Application No. PCT/EP2019/062383, filed May 14, 2019, which claims priority from European Patent Application No. 18305585.4 filed May 14, 2018, all of which are incorporated herein by reference.

FIELD OF THE INVENTION AND TECHNOLOGICAL BACKGROUND

The invention concerns reconfigurable antennas based on a 'metasurface of metasurfaces' or digital metasurfaces.

The invention can be used in various applications: High data-rate communications (Terabit Wireless), Internet of Things, Homeland security, Space technologies, Avionics and Aerospace Radar, Extended sensing systems for UAVs (incl. insertion in Air Traffic), Automotive systems, Naval systems.

Well-known reconfigurable antennas are electronically scanned phased array antennas and are based on two major technological approaches:

- reflect arrays which appears as the main low-cost approach for electronically scanned antennas but this approach suffers from the requirements of phase shifters per radiating elements which increase the final cost and the need of an out-of-plane primary RF source;
- transmit/receive arrays, the main limitation is also the requirement for transmit/receive modules per radiating elements including RF amplifiers and phase shifters increasing the thickness and the cost of the antennas.

Therefore, there is a need for having reconfigurable antennas which are reconfigurable without the need of individual phase shifters (one phase shifter par element of the phased array antenna), which is as planar or conformable as possible so that the size/dimensions and the weight of the antenna are lower than the ones of conventional phased array.

SUMMARY OF THE INVENTION

The invention proposes a reconfigurable metasurface antenna assembly without the above-mentioned drawbacks.

In particular, the invention proposes a reconfigurable antenna assembly based on the leaky wave mechanism through which a surface electromagnetic wave is transformed into a radiated wave when propagating along surfaces with special distributions of surface-impedance.

To this end, the invention concerns an antenna assembly according to claim 1

The antenna assembly of the invention may also comprises at least one of the following features, possibly in combination:

- the patches (or extreme elements) have dimensions smaller than $\lambda/40$ and preferably comprised between $\lambda/70$ to $\lambda/40$, where $\lambda$ is the wavelength corresponding to the frequency of the waves to be radiated and are preferably comprised between $\lambda/70$ to $\lambda/40$;
- each switch comprises a phase change material;
- each switch comprises electronic elements such as diodes or micro-electro-mechanical systems;

- the elements (or textural elements) in the second-scale metasurface have a geometrical area delimited by any arbitrary contour and may have disconnected vertexes in this area of the following pattern: discs, squares, rectangles.
- The isotropic source is configured for generating electromagnetic waves on the upper surface of the substrate on which the antenna element is formed;

The invention thus concerns a metasurface of metasurfaces, which is intended to be referred to the two different scales of the elements.

A metasurface antenna, generally speaking is composed of a set of patterns (eventually self-complementary) as a chessboard antenna for example: meaning that the metallic part of the antenna (set of patches deposited on a substrate) and the complementary part of the surface are equal and can be obtained by a two-dimensional translation).

A metasurface of metasurfaces is a set of metasurfaces, each including a set of patterns much smaller than the wavelength/frequency to be radiated.

The invention has several advantages.

The set of patterns of a metasurface of metasurfaces does not depend on the frequency/wavelength to be radiated.

The patterns of self-complementary structures form a planar diffractive grating for which its arrangement allows to select a diffraction order specific to the generation of evanescent waves emitted out of plane.

The patterns can be interconnected to form patterns of larger size and shaped to be adapted to the radiation pattern of the antenna assembly and to the polarization of the corresponding waves.

The use of the ground plane on the lower surface of the substrate contributes to the propagation of the waves on the upper surface of the substrate.

Phase shifters are not needed in this antenna; the phase shift is achieved by exploiting the electromagnetic propagation through the array of (meta)material patches forming the metasurface.

With this antenna, it is possible to design the position of the connections between the patches in order to achieve the desired antenna characteristics of beam scanning and reconfigurability.

Advantageously, the connections among the vertexes of the patches will allow to establish a code which can be associated with a particular configuration of beam pointing, almost undetectable by reverse engineering. Therefore, we can consider the antenna as "crypted".

The shape/profile of elementary set of metasurfaces allows the control of the incident/radiated signal polarization.

BRIEF DESCRIPTION OF THE DRAWINGS

Other features and advantages of the invention will appear in the following description. Embodiments of the invention will be described with reference to the drawings, in which.

DETAILED DESCRIPTION OF THE INVENTION

Figure 1:
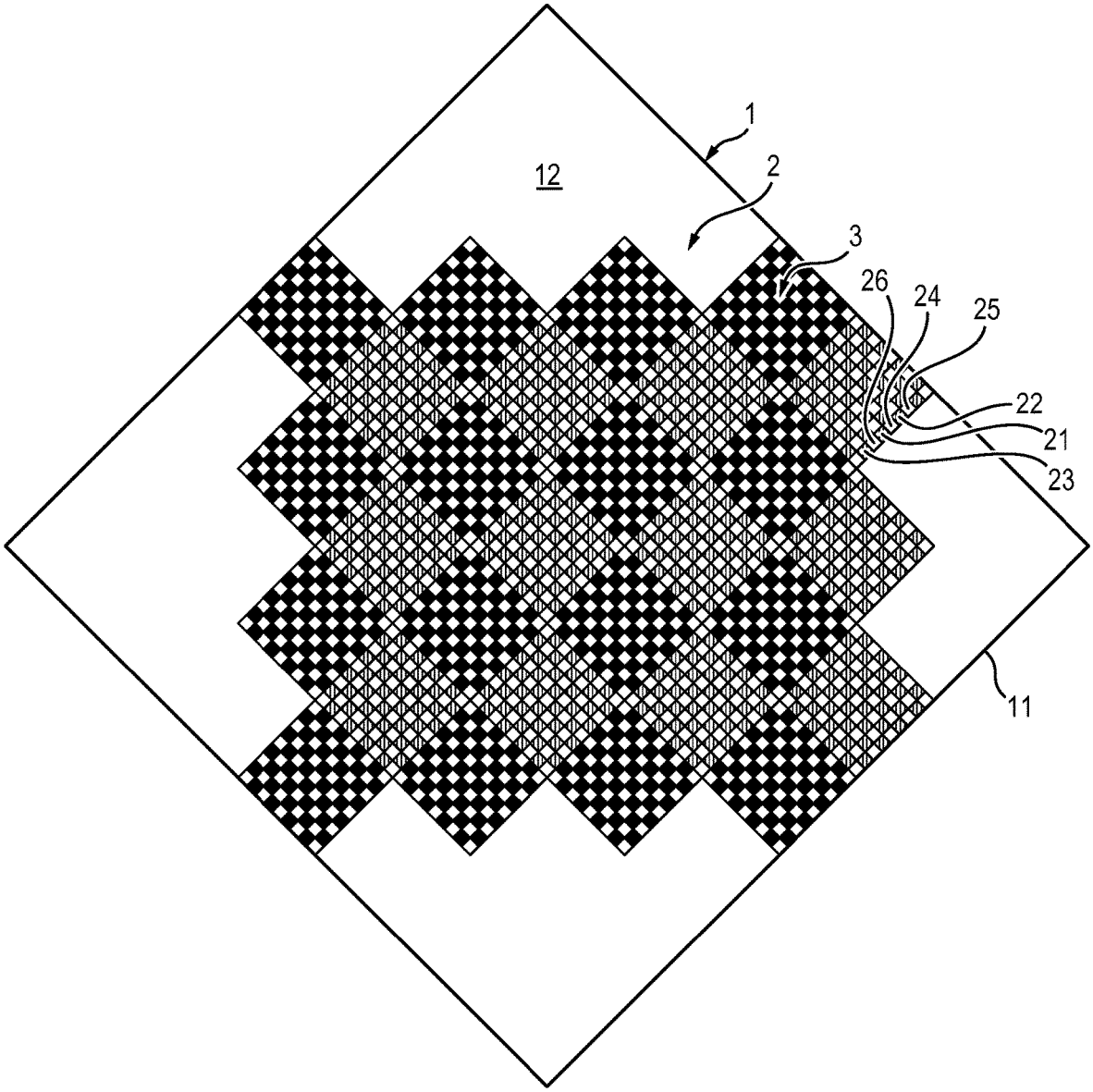
FIG. 1 illustrates an antenna assembly according to one embodiment of the invention.

FIG. 1 illustrates an antenna assembly comprising a single substrate 1, an antenna element 2 formed on the substrate. The substrate comprises an upper surface 12 on which the antenna element 2 is formed and a lower surface 11 on which a ground plane (not shown) is formed.

The ground plane is constituted by a metallic deposit on the entire lower surface 11 of the substrate 1.

The antenna assembly also comprises an isotropic source of spherical electromagnetic waves configured for emitting surfaces waves on the upper surface of the substrate 1. The electromagnetic waves are preferably microwaves.

The substrate is for instance a dielectric such as polymers, glass-epoxy, ceramic, Teflon, glass reinforced hydrocarbon/ceramic laminates or sheets of paper, or semiconducting material, confined liquid crystal, or vanadium dioxide. Any shape can be used and according to the radiation frequency of the antenna a thickness in the range from a few μm to a few could be used.

The antenna element 2 and the ground plane are made from conductive materials for instance copper or gold etc.

The antenna element is preferably constituted of a two-dimensional periodic array of an alternance of metamaterial micro-patches 21, 22, 23 and apertures 24, 25, 26 defining a first-scale metasurface. In particular, the antenna element is constituted by a multiscale texture of extreme subwavelength patches denoted as "extreme elements" (having dimensions that are small in terms of the wavelength). Each patch cannot be radiate independently of each other due to the structure of the antenna element.

The extreme elements are based on conductive materials such as copper or gold for examples, deposited by low-cost conventional technological processes (two or three steps) such as optical or electrical lithography, or inkjet/3D printing.

Figure 2:
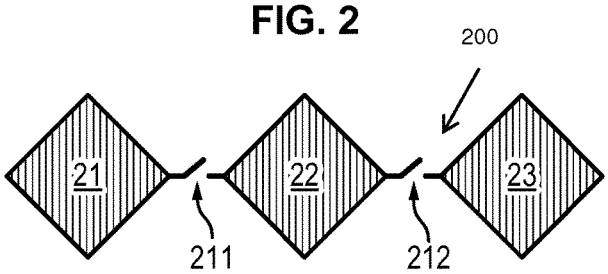
FIG. 2 illustrates patches of the antenna assembly of FIG. 1.

The period and the dimensions of the extreme elements constituting the first-scale metasurface is extremely subwavelength and can range from λ/70 to λ/40 at any operative antenna frequency. A preferred period is smaller than λ/65. As illustrated on FIG. 2, the antenna element comprises gaps 200 between the vertexes of the extreme elements 21, 22, 23 and switches 211, 212 are disposed in the gaps.

Figure 3A:
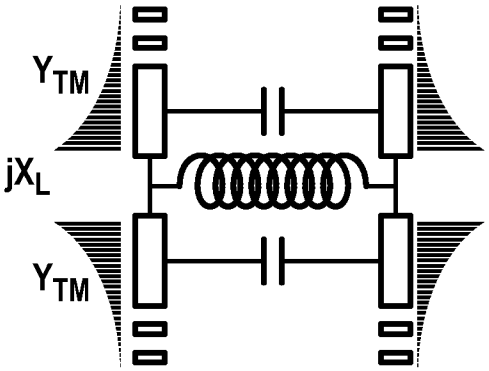
FIG. 3*a* and FIG. 3*b* illustrate the principle of the connection between vertices of patches of the antenna assembly of the invention.
Figure 3A:
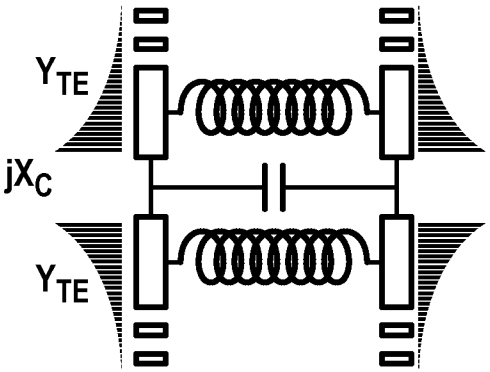
Figure 3A:
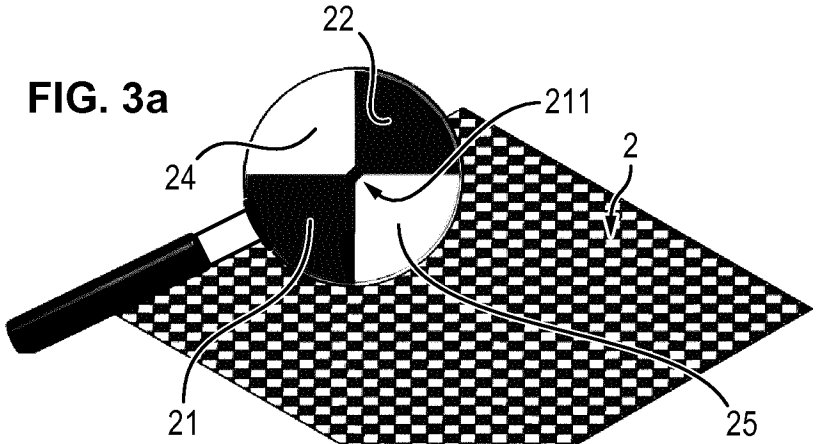
Figure 3B:
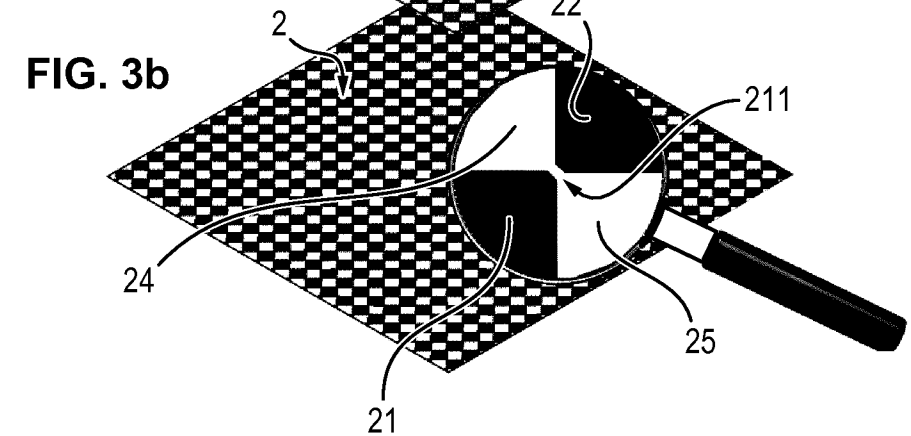

The switches permit to electrically connect the extreme elements though the vertexes for defining a second-scale metasurface having a pattern thus forming the antenna element. FIG. 3*a* and FIG. 3*b* illustrates the connection or the missing connection of the patch vertices that determines the equivalent transmission line load.

The second-scale metasurface is thus constituted of patches each constituted of the extreme elements of the first metasurface. The patches of the second metasurface have dimensions larger than the ones of the patches of the first-scale metasurface. The second-scale metasurface is also denoted as a surface of "textural elements" i.e., the patches each constituted by the extreme elements that are connected. The antenna element is a metasurface which is a function of another metasurface that has been tuned. Area numbered 3 on FIG. 1 shows textural element of the second-scale metasurface which is constituted of extreme elements of the first-scale metasurface.

In a preferred embodiment, the switching between states may be achieved through either diodes or micro-electro-mechanical systems (MEMS) as localized (relatively) self-contained switches between two points between the extreme elements, due to the small size of the vertex region. Furthermore, other switching mechanisms such that the use of phase changing materials are possible.

By designing the pattern of the metasurface of metamaterial it is possible to modify the antenna radiation pattern and to adjust the surface impedance modulation.

In particular, by introducing the possibility to connect the extreme elements of the first-scale metasurface it is possible to consider a first-scale metasurface composed of only two materials and to combine the two materials in order to mimic other materials with dielectric permittivity values that are not only within the values of permittivity of the two media, but also outside of this range.

The possibility of mimicking a big range of surface impedances with only two materials is very advantageous in terms of reconfigurability of the antenna element since the reconfiguration is not very complex.

Further, the large possibility of the combination of extreme elements and gap provides a large number of degrees of freedom for the design of the antenna element.

Another advantage to configure the antenna pattern through connections of the extreme elements of a first metasurface is that these connections are not visible to the naked eye. Thus, the antenna element can be considered as "crypted" and not directly obtained by reverse engineering.

An additional benefit can come from the fact that the connections between the extreme elements are only present when the connections are switched on by electronic means. In that case, the modifications of the connections are used to scan the radiated beam and accordingly the connections between the extreme elements will change from time to time.

As mentioned below, the dimensions of the patches (or extreme elements) of the first metasurface are around λ/40 to λ/70 compared to the wavelength of the antenna. As an example, for a radiation at 10 GHz, 1=30 mm, the dimensions of the extreme elements are around 500 μm with a gap between adjacent extreme elements around 10 μm (under the resolution limit of the naked eye).

Figure 4:
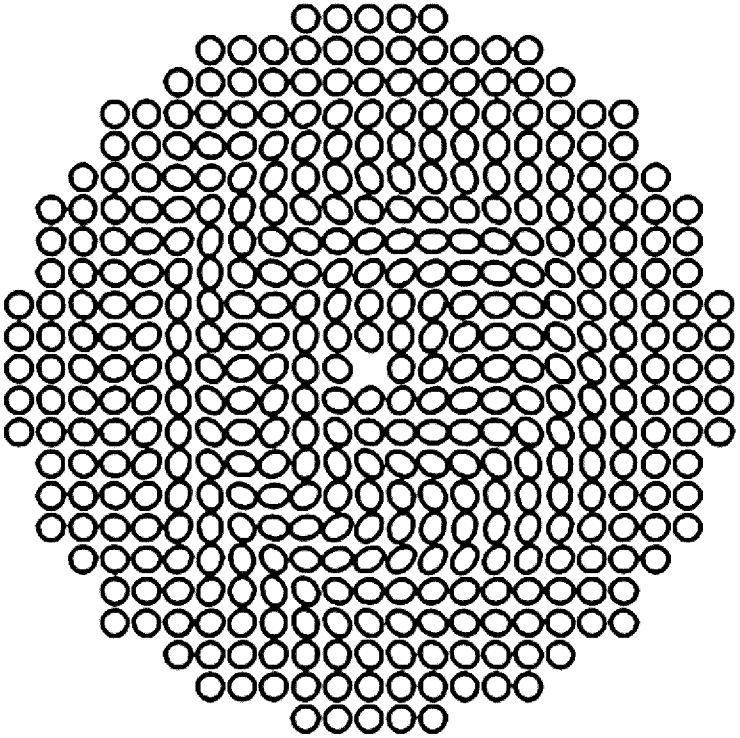
FIG. 4 illustrates the elementary design of an antenna element of an antenna assembly of the invention.

In order to design the antenna element, a full wave modeling of the metasurface structure as illustrated on FIG. 4 is used. This illustrates an antenna element comprising elliptical patches or circle patches.

Having this analytical design, the antenna element is then designed from a first metasurface.

In particular, by properly connecting several patches, we obtain a so called digital metasurface antenna.

Figure 5B:
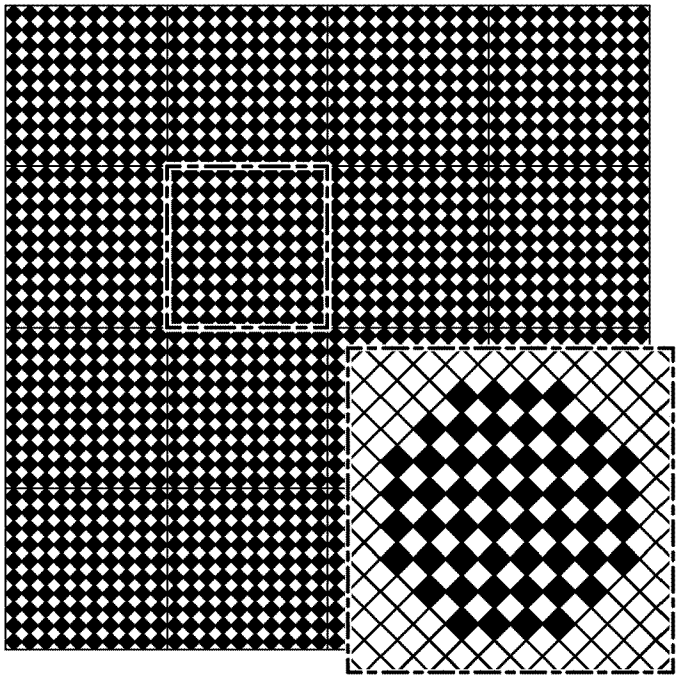
FIGS. 5*a* to 5*h* illustrate several patterns of an antenna element of the antenna assembly of the invention.
Figure 5A:
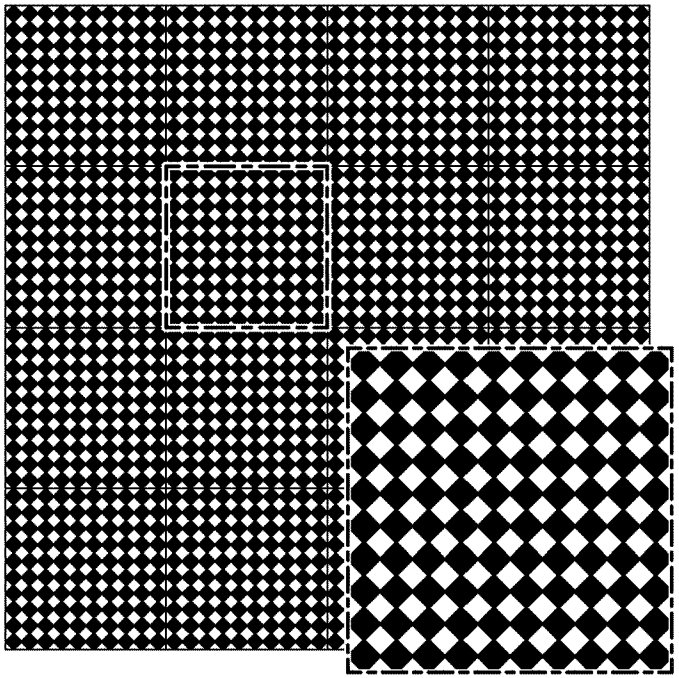
Figure 5C:
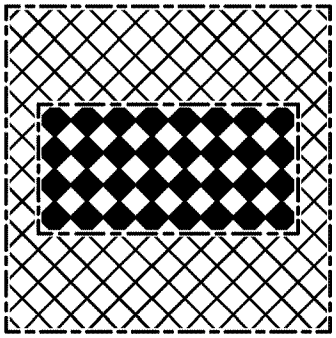
Figure 5D:
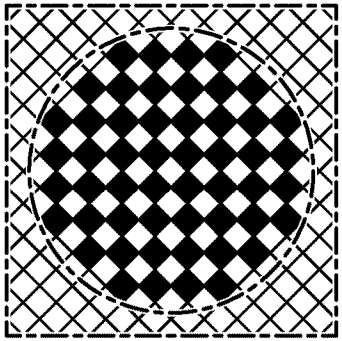
Figure 5E:
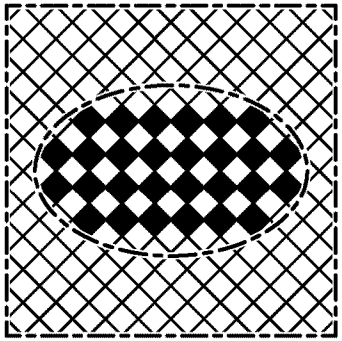
Figure 5F:
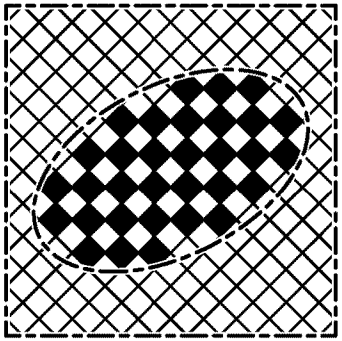
Figure 5G:
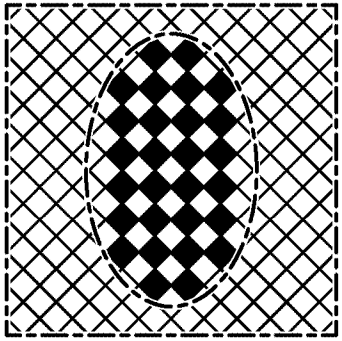
Figure 5H:
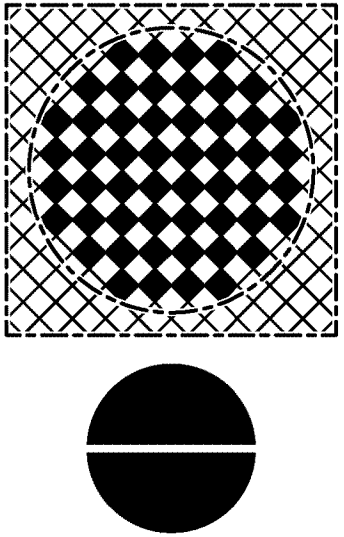
Figure 5H:
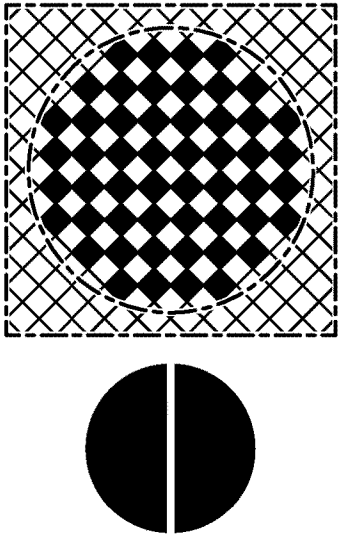

With this configuration of metasurface of metasurfaces (called also digital metasurface), it is possible to obtain any type of metasurface pattern such as described in FIGS. 5*a* to 5*g*:

- FIG. 5*a*: squared pattern (the interconnected patches form a square), the antenna is a set of squares;
- FIG. 5*b*: diamond pattern (the interconnected patches form a diamond), the antenna is a set of diamonds;
- FIG. 5*c*: (the interconnected extreme elements form a rectangle) diamond, the antenna is a set of diamonds;
- FIG. 5*d*: disc pattern (the interconnected extreme elements form a disc), the antenna is a set of discs;

FIG. 5*e*: oval (ellipsoidal) pattern (the interconnected extreme elements form an oval surface), the antenna is a set of oval surfaces;

FIG. 5*f*: oval pattern at 45° main axis orientation (the interconnected extreme elements form a oval surface oriented at 45°), the antenna is a set of oval surfaces oriented at 45°;

FIG. 5*g*: oval pattern at 90° main axis orientation (the interconnected extreme elements form a oval surface oriented at 90°), the antenna is a set of oval surfaces oriented at 90°;

FIG. 5*h*: left: disc pattern "coffee bean" (the interconnected extreme elements form a 'coffee bean' pattern), the antenna is a set of "coffee beans". Right disc pattern "coffee bean" at 90° (the interconnected patches form a "coffee bean" pattern), the antenna is a set of "coffee beans").

Figure 6:
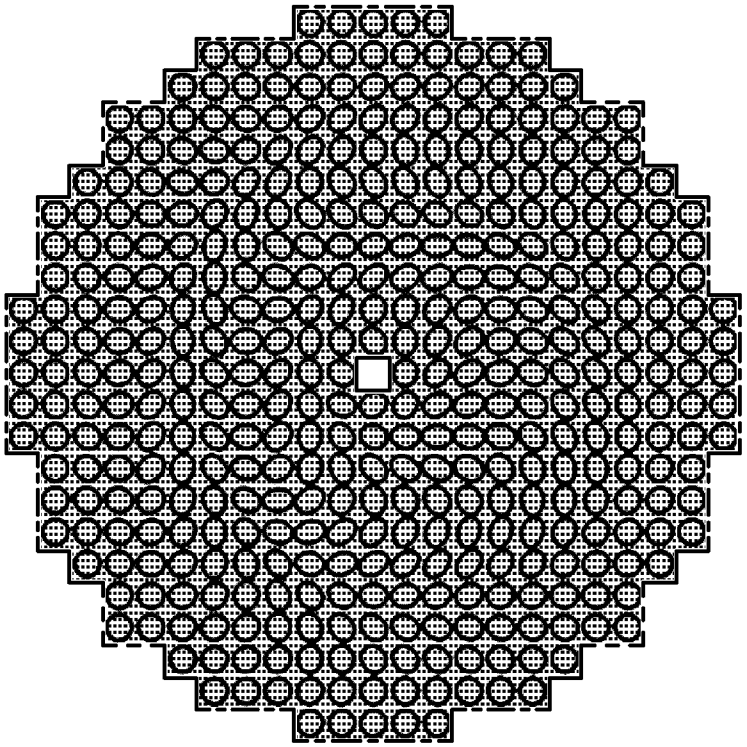
FIG. 6 illustrates the corresponding metasurface of the design of FIG. 4.

An antenna having the following characteristics has been experimented and illustrated on FIG. 6 (the corresponding analytical one is illustrated on FIG. 4):

Diameter 3λ, i.e. =5 cm.

Beam 30°.

Frequency 18 GHz.

Substrate characteristics: Permittivity, $e_r$=9.8, Thickness, h=0.762 mm fed by a via connected to a central round patch As known, the metasurface transforms the surface wave into a leaky wave whose radiation direction is controlled by the periodicity d of the modulation. The tensorial reactance is synthesized by a dense texture of subwavelength metal patches printed on a grounded dielectric slab and excited by an in-plane feeder.

In the experimented antenna, the textural elements of the second-scale metasurface have a circular shape with a narrow slit along their diameter like 'coffee bean'; the reactance tensor depends on both the area covered by the patch and the slit tilt angle with respect to the surface wave direction of incidence.

Modifying the area of the textural element produces a variation of the amplitude of the radiation, whereas, rotating the slit tilt controls the polarization of the radiated field.

Figure 7:
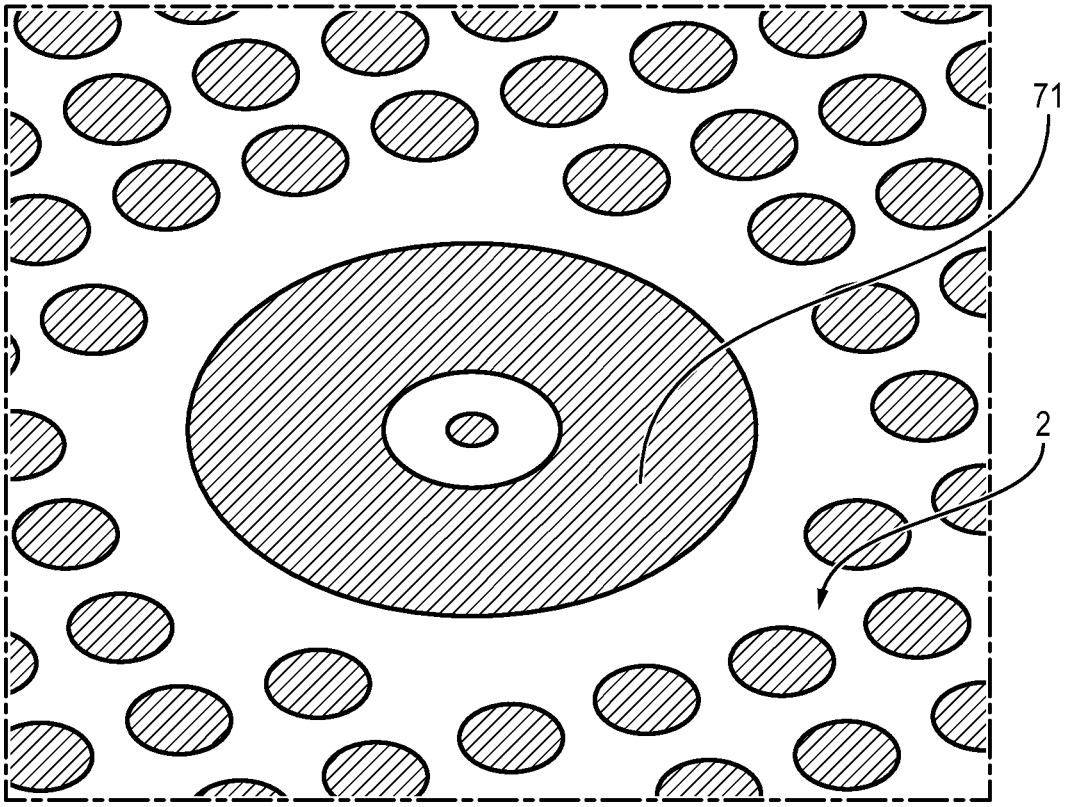
FIG. 7 illustrates the excitation of the antenna element.

To excite a surface wave with rotating phase, a resonant circular patch is placed at the center of the multiscale metasurface. The patch is printed at the same level of the multiscale metasurface and is excited in sequential rotation by four pins disposed symmetrically with respect to the patch center. FIG. 7 illustrates this type of excitation of the metasurface via a resonant circular patch 71 placed at the center of the multiscale metasurface.

The role of the patch is double: to excite a surface wave along the metasurface and to radiate directly in the broadside direction for adjusting the radiation pattern level.

Figure 8:
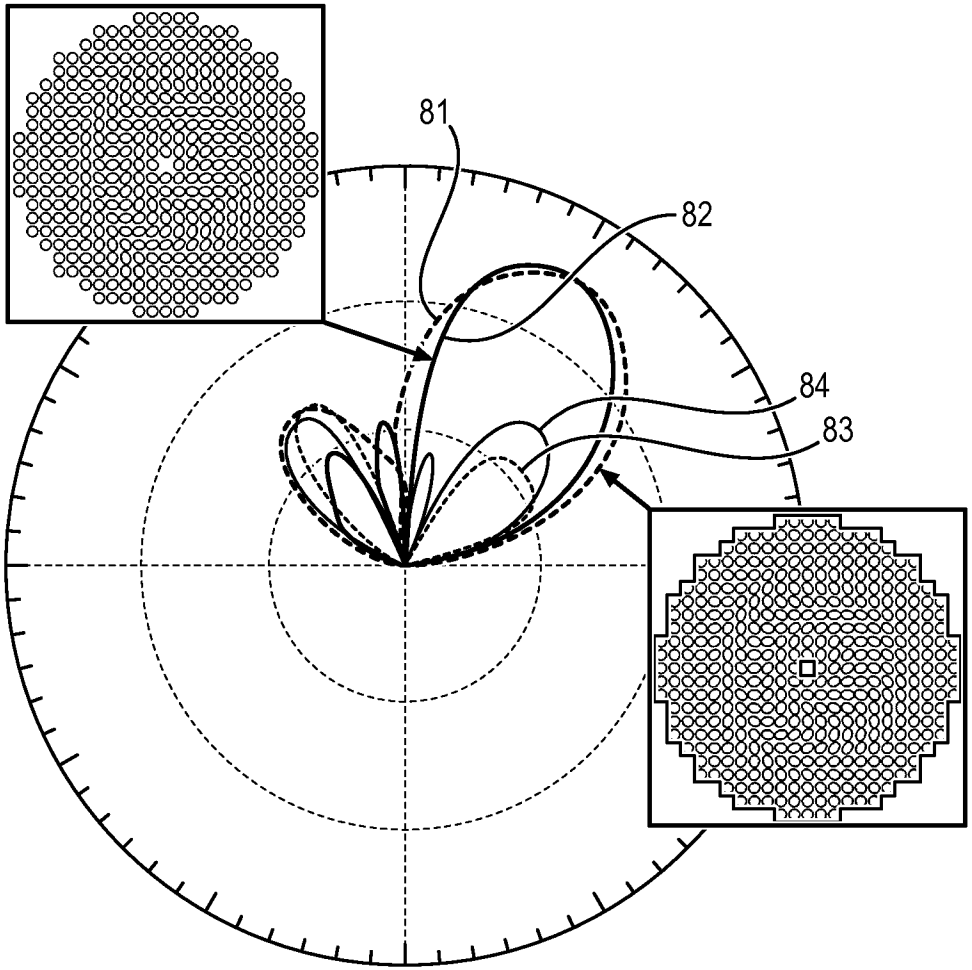
FIG. 8 illustrates performances of the antenna assembly of FIG. 5.

The performances of the analytical antenna and the corresponding digital antenna have been established and compared and then illustrated on FIG. 8.

The conventional antenna (curves 81, 82) and the metasurface of metasurfaces or digital metasurface antenna (curves 83, 84) have been simulated and the results (curves 82, 84) quite similar thus validating the concept of metasurface of metasurfaces or digital metasurface antenna.

The invention claimed is:

1. Antenna assembly, comprising:

a single substrate having a lower surface and an upper surface;

an isotropic source of spherical electromagnetic waves configured for emitting surfaces waves on the upper surface of the substrate;

a ground plane formed on the lower surface of the substrate constituted by a metallic deposit on the entire lower surface;

an antenna element formed on the upper surface of the substrate said antenna element being constituted by a periodic patterns metasurface formed on the substrate by a texture of subwavelength patches, said antenna element being constituted of a first-scale metasurface defined by a two-dimensional alternation of metal or metamaterial patches having closely spaced vertices in each contiguous element thus forming small gaps;

a plurality of switches disposed in the gap between the vertexes of the patches, each switch permitting to connect several patches through the vertexes for defining a second-scale metasurface having a pattern thus forming the antenna element; wherein each patch has dimensions which do not depend to the frequency of the waves to be radiated, the antenna element being configured for transforming the emitting surface waves on leaky waves.

2. Antenna assembly according to claim 1, wherein the patches have dimensions smaller than λ/40 where λ is the wavelength corresponding to the frequency of the waves to be radiated and are preferably comprised between λ/70 to λ/40.

3. Antenna assembly according to claim 1, wherein each switch comprises a phase change material.

4. Antenna assembly according to claim 1, wherein each switch comprises electronic element such as diodes or micro-electro-mechanical systems.

5. Antenna assembly according to claim 1, wherein the second-scale metasurface is formed by one of the following patterns: discs, squares, rectangles.

* * * * *